US012029314B2

(12) United States Patent
Ryöppy

(10) Patent No.: US 12,029,314 B2
(45) Date of Patent: Jul. 9, 2024

(54) DEVICE FOR CABLE MANAGEMENT

(71) Applicant: PIXELFLAKE OY, Tampere (FI)

(72) Inventor: Toni Ryöppy, Tampere (FI)

(73) Assignee: PIXELFLAKE OY, Tampere (FI)

( * ) Notice: Subject to any disclaimer, the term of this patent is extended or adjusted under 35 U.S.C. 154(b) by 0 days.

(21) Appl. No.: 18/037,541

(22) PCT Filed: Nov. 16, 2021

(86) PCT No.: PCT/FI2021/050776
§ 371 (c)(1),
(2) Date: May 17, 2023

(87) PCT Pub. No.: WO2022/106753
PCT Pub. Date: May 27, 2022

(65) Prior Publication Data

US 2023/0397719 A1 Dec. 14, 2023

(30) Foreign Application Priority Data

Nov. 18, 2020 (FI) ..... 20206173

(51) Int. Cl.
*A47B 21/06* (2006.01)
*A47B 97/00* (2006.01)

(52) U.S. Cl.
CPC ..... *A47B 21/06* (2013.01); *A47B 2097/003* (2013.01)

(58) Field of Classification Search
CPC . A47B 21/00; A47B 21/061; A47B 2097/003; A47B 2200/008; A47B 2200/0082; A47B 2021/066
USPC ..... 108/50.02; 312/223.6
See application file for complete search history.

(56) References Cited

U.S. PATENT DOCUMENTS 5,787,955 A 8/1998 Dargie
5,809,900 A * 9/1998 Alexander ..... A47B 21/06 108/26
6,192,805 B1 * 2/2001 Saylor ..... A47B 21/06 108/26
7,417,850 B1 * 8/2008 Pulido ..... A47B 21/06 361/679.01

(Continued)

FOREIGN PATENT DOCUMENTS

CN 207023689 U 2/2018
DE 20210220 U1 9/2002

(Continued)

OTHER PUBLICATIONS

FI Office Action in application No. 20206173 dated Mar. 15, 2022.

*Primary Examiner* — Jose V Chen
(74) *Attorney, Agent, or Firm* — Maschoff Brennan

(57) ABSTRACT

A device for cable management has a rectangular cloth that is tightened from four corners to an underside of a table. The cloth supports cables, power sources or other electrical accessories against the table. The cloth may be canvas, fabric, net, mesh or similar, made from flexible thin material. The cloth is lifted close to the table by tightening a cord that travels inside the outer seams. The cord is tightened against four fastening means at each corner of the rectangular cloth. The arrangement allows items of various sizes and shapes to be supported and gently pushed against the underside of the table.

8 Claims, 2 Drawing Sheets

(56) References Cited

U.S. PATENT DOCUMENTS 11,757,267 B1* 9/2023 Reddig ..... A47B 9/20 174/68.3
2002/0056503 A1* 5/2002 Kochte ..... B29C 66/4722 156/304.1
2006/0278794 A1* 12/2006 Rast ..... A47B 21/06 248/346.01
2009/0255702 A1* 10/2009 Mitchell ..... A47B 21/06 174/50
2010/0011553 A1 1/2010 Mazza et al.
2011/0043007 A1 2/2011 Jones
2012/0037766 A1 2/2012 Buras, Jr. et al.
2014/0040781 A1* 2/2014 Epstein ..... G06F 1/1632 715/753
2014/0096706 A1* 4/2014 Labrosse ..... G05B 19/048 108/21
2015/0187460 A1* 7/2015 DeLoache ..... A47B 21/06 248/68.1
2016/0205797 A1* 7/2016 Mangione ..... H02G 11/003 174/535
2019/0291654 A1 9/2019 Takeda
2021/0204690 A1* 7/2021 Lim ..... A47B 13/02
2021/0226430 A1* 7/2021 Gieselmann ..... H02G 3/32
2023/0006475 A1* 1/2023 Joo ..... H02J 50/005
2023/0133279 A1* 5/2023 Riner ..... H02G 3/0406 439/542
2023/0232562 A1* 7/2023 Hopkins ..... H05K 7/12 248/74.5
2023/0255347 A1* 8/2023 Jiang ..... H02S 40/34 108/50.02
2023/0275410 A1* 8/2023 Cianciolo ..... D04B 1/22 248/548

FOREIGN PATENT DOCUMENTS

EP 3485765 A1 5/2019
FI 20206173 A1 * 5/2022

* cited by examiner

DEVICE FOR CABLE MANAGEMENT

BACKGROUND

The invention relates to managing or organizing cables, power supplies, chargers or other wired electronic accessories. Said items are often hidden under an office desk or stuck behind a TV stand. Electric appliances in domestic or office use require electric power to operate. Even the wireless devices need charging. The home entertainment systems and game consoles have various wired accessories that often clutter the floor. The cable clutter on the floor is difficult to dust, it must be cleaned manually. They prevent the operation of robotic vacuum cleaners or other automated cleaning systems.

Cable organizers solve the problem by providing a support that collects the cables and/or power sources and keep them in the organizer. In the office use, cable baskets are connected to an underside of a table, wherein the items may be tucked away from sight, leaving the floor uncluttered. The cable baskets are often relatively tall, allowing them to be visible. For example, cable basket attached to the underside of a living room table may be visible when sitting on a sofa. DE20210220U1 discloses a cloth attached to an underside of a table, wherein cables may be hidden between the cloth and the table.

SUMMARY

This summary is provided to introduce a selection of concepts in a simplified form that will be further described below in the detailed description. This summary is intended to neither identify key features or essential features of the claimed subject matter nor to be used to limit the scope of the claimed subject matter. Furthermore, the claimed subject matter is not limited to implementations that solve any or all of the disadvantages noted in any part of this disclosure.

A device for cable management is disclosed hereinafter. The device has a rectangular cloth that is tightened from four corners to an underside of a table. The rectangular cloth supports cables, power sources or other electrical accessories against the table. The cloth may be canvas, fabric, net, mesh or similar, made from flexible and thin material. The cloth is lifted close to the table's underside by tightening a cord that travels inside the outer seams. The cord is tightened against four fastening means at each corner of the rectangular cloth. The arrangement allows items of various sizes and shapes to be supported and gently pushed against the underside of the table.

The four fastening means are positioned close to the table surface. The cloth, the cord and the fastening means are all thin components, allowing the device to be flush under the table. The cloth may have the same colour as the table, wherein the electronic accessories and cables hidden under the cloth are camouflaged, reminiscing the table structures. The flexible structure is suitable for hiding various objects, such as cables, chargers, even larger power sources for gaming consoles or other appliances, or extension cords.

Many of the attendant features will be more readily appreciated as they become better understood by reference to the following detailed description considered in connection with the accompanying drawings. The embodiments described below are not limited to implementations which solve any or all the disadvantages of known cable management devices or cable organizers.

BRIEF DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. However, the same or any equivalent functions and sequences may be accomplished by different examples.

Although the present examples are described and illustrated herein as being implemented in managing cables, they are provided as an example and not a limitation. As those skilled in the art will appreciate, the present examples are suitable for application in a variety of different types of items, electronic accessories, chargers or other usually movable devices related to providing electrical power to devices or transferring data between devices.

Figure 1:
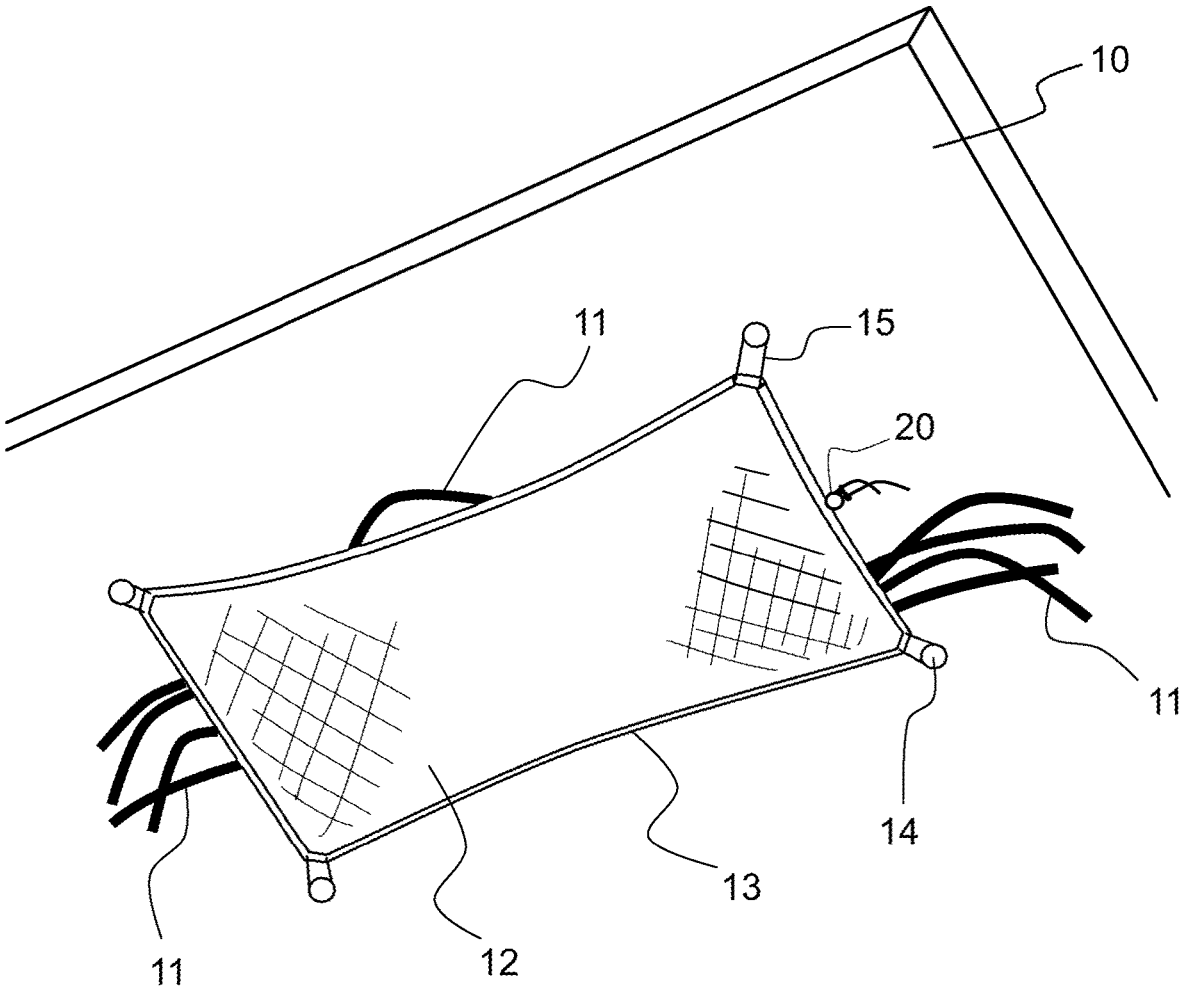
FIG. 1 illustrates schematically one exemplary embodiment of a device.
Figure 2:
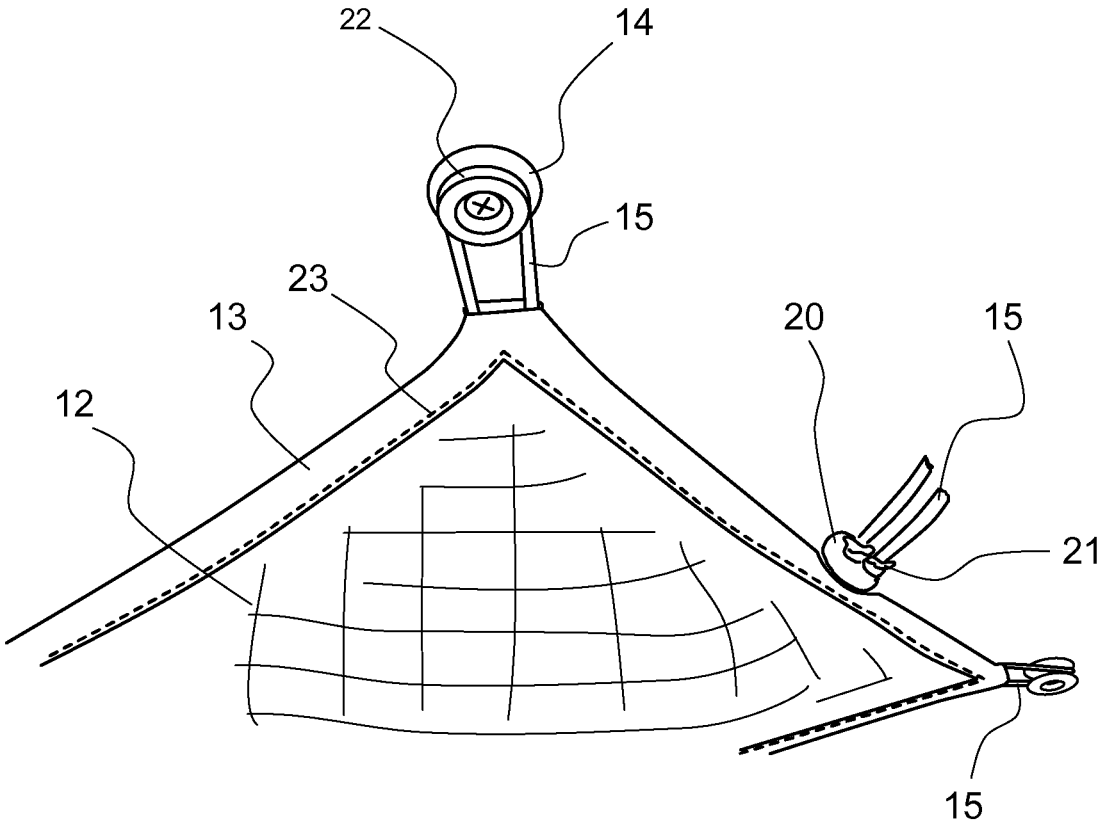
FIG. 2 illustrates schematically a partial view of one exemplary embodiment of the device.

FIG. 1 illustrates schematically one exemplary embodiment of a device for cable management. FIG. 2 illustrates schematically a detail of the same exemplary embodiment. The device for cable management comprises a rectangular cloth 12 having four edges 13, configured to support multiple cables 11 or electronic accessories. The rectangular cloth 12 may be made of a fabric, a mesh, a net, a flexible membrane or a combination thereof.

A cord 15 is at least partially connected to the rectangular cloth 12. The cord 15 travels, at least partially, along the edges 13. The cord 15 is configured to tighten the rectangular cloth 12 outwards, so the rectangular cloth 12 would rise and lift the cables 11 towards an underside of a table 10. The cord 15 is in one embodiment connected loosely to the rectangular cloth 12. In one embodiment the rectangular cloth 12 is a net and the cord 15 travels via its outer loops.

In one embodiment the cord 15 is configured to travel along the edges 13 inside a tunnel formed by a seam 23. The tunnel may allow the cord 15 to travel freely, to avoid forming wrinkles to the rectangular cloth 12. In one embodiment the cord 15 is configured to travel along the edges 13 inside a tunnel belt loop. The tunnel belt loops may be connected to the outer edge 13 of the rectangular cloth 12.

The cord 15 travels outside the rectangular cloth 12 at each corner. The cord 15 exits the rectangular cloth 12 from the corner, travels via fastening means 14 and re-enters the rectangular cloth 12 at the same corner. The fastening means 14 is attachable to the underside of the table 10. Each fastening means 14 is positioned outside the corner and outside the perimeter of the rectangular cloth 14, wherein pulling the cord 15 via the fastening means 14 pulls each corner of the rectangular cloth 12 towards the fastening means 14. The cord 15 is not tied to the fastening means 14, it is movable to enable tightening the cord. In one embodiment the cord 15 is tied to one of the four fastening means 14. The cord 15 is in one embodiment a flexible cord. In one embodiment the cord 15 is made of rubber. In one embodiment the cord 15 is inflexible.

In one embodiment the fastening means 14 comprises a wheel 22 with a grooved rim around which the cord 15 passes. The cord 15 may sit inside the grooved rim, wherein the grooved rim holds the cord 15 in its place, when the device is assembled. In one embodiment the cord 15 is temporarily removable from the fastening means 14, for example to insert new cables or accessories between the table 10 and the rectangular cloth 12. The grooved rim may comprise a retaining lip, wherein the cord 15 snaps past the retaining lip when inserted into the grooved rim and stays in its place, even without the pulling force from the other fastening means 14. In one embodiment the cord 15 is made of flexible material, which may be pushed into the grooved rim.

In one embodiment the fastening means 14 comprises a pulley. The pulley is one example of a wheel 22. In one embodiment the wheel 22 rotates, in one embodiment the wheel is fixed. In one embodiment the fastening means 14 is a hook, open to opposite side to its near corner of the rectangular cloth 12. The cable 15 may be suspended by the hooks, one by one, when assembling the device.

In one embodiment, the fastening means 14 comprises a screw for fastening the fastening means 14 onto the underside of the table 10. Alternatively, or in addition, the fastening means 14 comprises an adhesive for fastening the fastening means 14 onto the underside of the table 10. The table 10 may be made of wood, providing easy material for the screw. For various table materials, the fastening means 14 may be glued to the underside of the table 10. A retail package of the device may contain instructions for the dimensions or measurements for fastening the fastening means 14. In one embodiment, the retail package contains a template for marking the spots for the fastening means 14.

The device comprises tightening means 20 for tightening the cord 15 travelling at least partially inside the rectangular cloth 12. In one embodiment the tightening means 20 comprises a cord stopper. The two opposite portions of the cord 15 exiting the rectangular cloth 12 are connected to the cord stopper for adjusting the amount of cord 15 travelling inside the seam 23 or along the outer edges 13. When the cord 15 is being tightened, the cord 15 is first released from the cord stopper, then tightened and finally reattached to the cord stopper. The cord stopper is in one embodiment a closed clamp operated by a spring and a push button, wherein pushing the push button releases the cord 15. In one embodiment, the at least one portion of the cord 15 exiting the cord stopper comprises a knot 21 for retaining the cord's 15 end outside of the cord stopper or at the cord stopper. In one embodiment, the knot 21 is an object integrated into the cord 15, increasing its diameter and preventing it from slipping through the cord stopper.

The tightening means 20 may be positioned at one of the corners, along the fastening means 14 or being integrated with the fastening means 14. In one embodiment, two opposite portions of the cord 15 are configured to exit the middle portion of one edge 13 of the rectangular cloth 12.

A device for cable management is disclosed, comprising a rectangular cloth having four edges, configured to support multiple cables against an underside of a table; a cord connected to the rectangular cloth, configured to travel along and at least partially inside the edges and outside the rectangular cloth at each corner; fastening means for fastening, to the underside of the table, the cord at each corner of the rectangular cloth; and tightening means for tightening the cord travelling at least partially inside the rectangular cloth. In one embodiment, the cord is a flexible cord. In one embodiment, the fastening means comprises a wheel with a grooved rim around which the cord passes. In one embodiment, the fastening means comprises a pulley. In one embodiment, the fastening means comprises a screw for fastening the fastening means onto the underside of the table. In one embodiment, the fastening means comprises an adhesive for fastening the fastening means onto the underside of the table. In one embodiment, two opposite portions of the cord are configured to exit the edge of the rectangular cloth at one edge. In one embodiment, the tightening means is a cord stopper, and the two opposite portions of the cord exiting the rectangular cloth are connected to a cord stopper for adjusting the amount of cord travelling inside a seam. In one embodiment, at least one portion of the cord exiting the cord stopper comprises a knot for retaining the cord end at the cord stopper. In one embodiment, the cord is configured to travel along the edges inside a seam. In one embodiment, the cord is configured to travel along the edges inside a tunnel belt loop.

Any range or device value given herein may be extended or altered without losing the effect sought.

Although at least a portion of the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that any reference to 'an' item refers to one or more of those items.

The term 'comprising' is used herein to mean including the method blocks or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. A device for cable management, comprising:

a rectangular cloth having four edges, configured to support multiple cables against an underside of a table;

a cord connected to the rectangular cloth, configured to travel along and at least partially inside the edges, inside a tunnel formed by a seam, and outside the rectangular cloth at each corner;

fastening means for fastening, to the underside of the table, the cord at each corner of the rectangular cloth;

tightening means for tightening the cord travelling at least partially inside the rectangular cloth; and the fastening means comprises a wheel with a grooved rim around which the cord passes.

2. The device according to claim 1, wherein the cord is a flexible cord.

3. The device according to claim 1, wherein the fastening means comprises a pulley.

4. The device according to claim 1, wherein the fastening means comprises a screw for fastening the fastening means onto the underside of the table.

5. The device according to claim 1, wherein the fastening means comprises an adhesive for fastening the fastening means onto the underside of the table.

6. The device according to claim 1, wherein two opposite portions of the cord are configured to exit the edge of the rectangular cloth at one edge.

7. The device according to claim 6, wherein the tightening means is a cord stopper, and the two opposite portions of the cord exiting the rectangular cloth are connected to the cord stopper for adjusting the amount of cord travelling inside a seam.

8. The device according to claim 7, wherein at least one portion of the cord exiting the cord stopper comprises a knot for retaining the cord end at the cord stopper.

* * * * *